US005943012A

United States Patent [19]

Sinclair

[11] Patent Number: 5,943,012

[45] Date of Patent: Aug. 24, 1999

[54] METHOD AND APPARATUS FOR EXCITING A TELEVISION ANTENNA USING ORTHOGONAL MODES

[75] Inventor: Gordon G. Sinclair, Mountain View, Calif.

[73] Assignee: TCI/BR Communication, Inc., Sunnyvale, Calif.

[21] Appl. No.: 09/071,477

[22] Filed: May 1, 1998

[51] Int. Cl.[6] ..... H01Q 3/26

[52] U.S. Cl. ..... 342/373; 342/361

[58] Field of Search ..... 342/373, 361, 342/362, 363, 364, 365

[56] References Cited

U.S. PATENT DOCUMENTS

| | | | |
|---|---|---|---|
| 4,051,474 | 9/1977 | Mack et al. | 343/100 LE |
| 4,101,892 | 7/1978 | Alford | 343/108 R |
| 4,107,688 | 8/1978 | Alford | 343/108 R |
| 5,036,331 | 7/1991 | Dallabetta et al. | 342/361 |

*Primary Examiner*—Thomas H. Tarcza
*Assistant Examiner*—Dao L. Phan
*Attorney, Agent, or Firm*—Ritter Van Pelt and Yi, LLP

[57] ABSTRACT

An antenna driving circuit for connecting an antenna to two transmitters is disclosed. The antenna driving circuit includes a hybrid combiner that has two isolated inputs. The hybrid is configured so that when a first signal is input to the first input, substantially one half of the energy of the first signal is output at the first output and the first signal is phase shifted by about −90 degrees at the first output. Substantially one half of the energy of the first signal is output at the second output and the first signal is phase shifted by about 0 degrees at the second output. When a second signal is input to the second input, substantially one half of the energy of the second signal is output at the second output and the second signal is phase shifted by about −90 degrees at the second output. Substantially one half of the energy of the second signal is output at the first output and the second signal is phase shifted by about 0 degrees at the first output. The input of a first power splitter is connected to the first output of the hybrid combiner and the output of the first power splitter is suitable for driving a first pair of dipole antenna arrays. The first pair of dipole antenna arrays are oriented in substantially opposite spatial directions. The input of a second power splitter is connected to the second output of the hybrid combiner and the output of the second power splitter is suitable for driving a second pair of dipole antenna arrays. The second pair of dipole antenna arrays are oriented in substantially opposite spatial directions that are oriented about 90 degrees away from both of the spatial directions of the first pair of dipole antenna arrays.

5 Claims, 12 Drawing Sheets

Block Diagram of TCI Orthogonal Mode Combiner

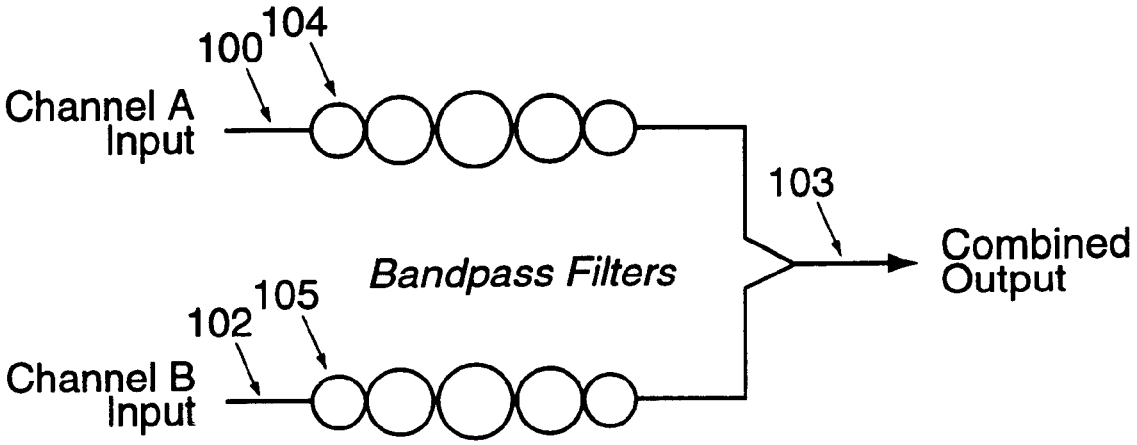
Figure 1A. Schematic Diagram, Starpoint Combiner

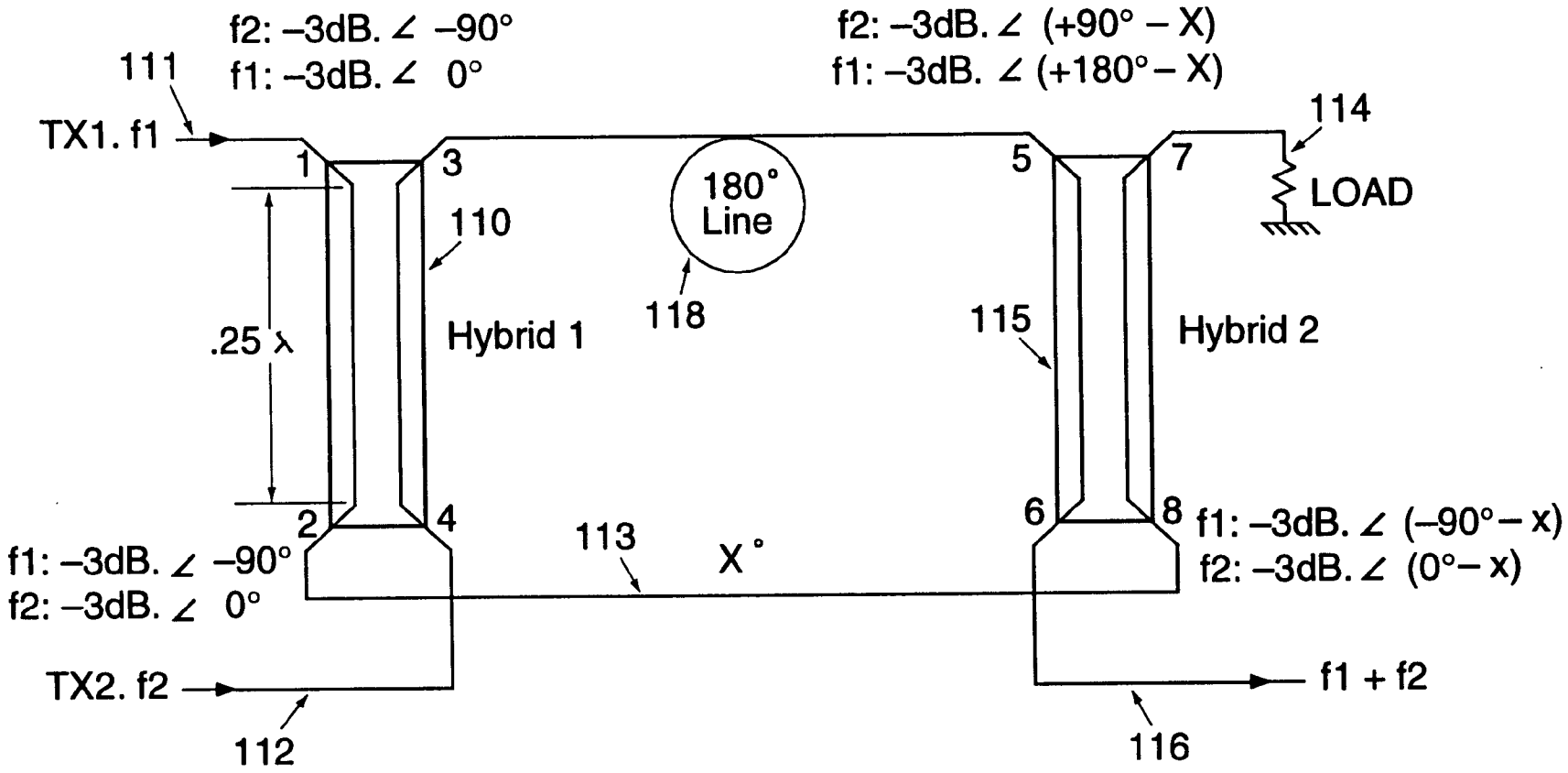
Figure 1B. Schematic Diagram, Commutating Line Combines

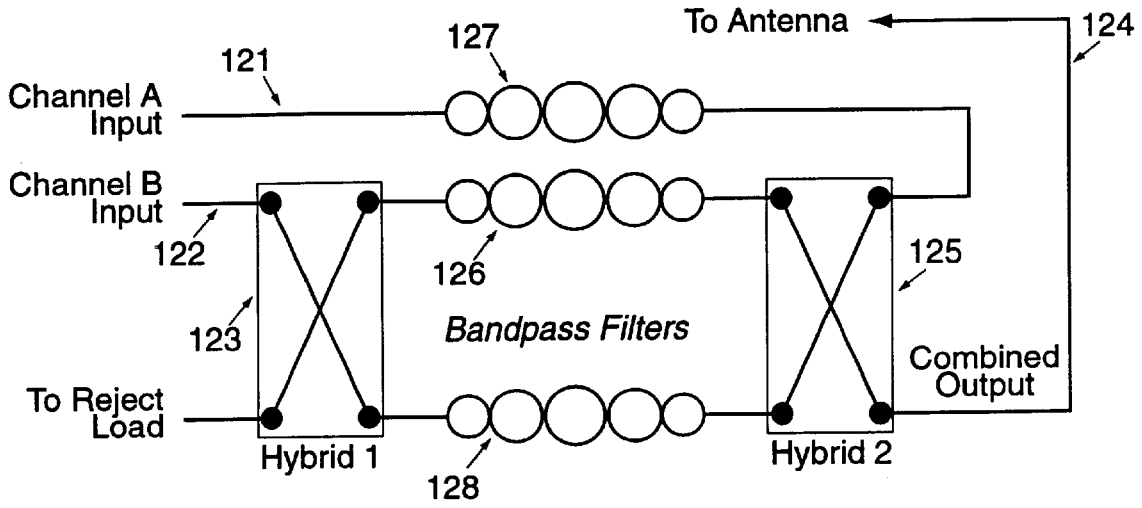
Figure 1C. Schematic Diagram, Constant Impedance Combines

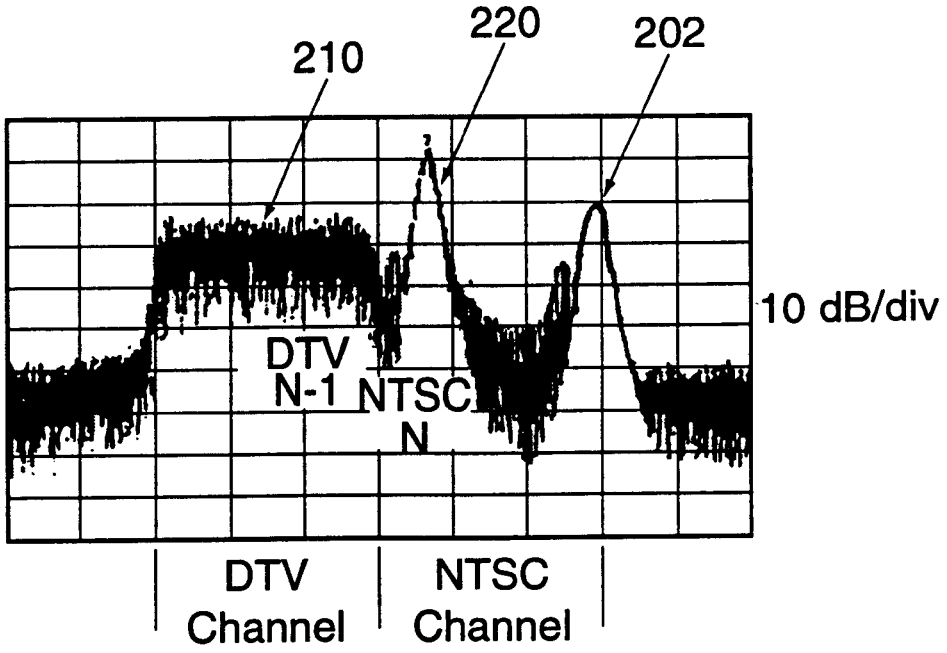
Figure 2A: N-1 Lower Adjacent
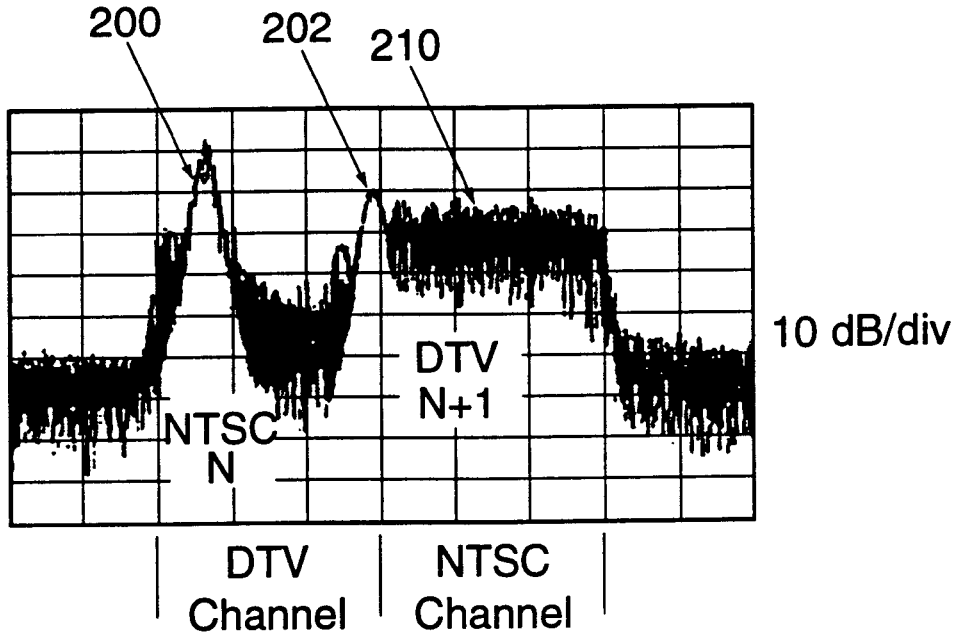
Figure 2B: N+1 Lower Adjacent

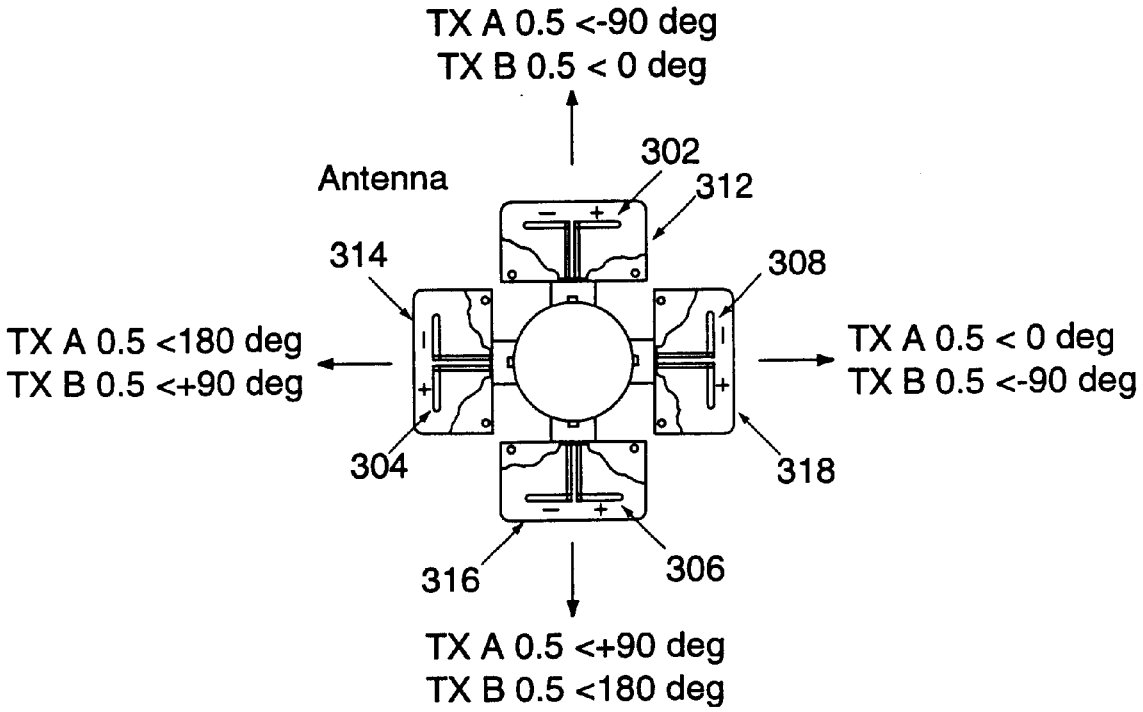
Figure 3. Dipole Panel Antenna Feed with Two Orthogonal Modes

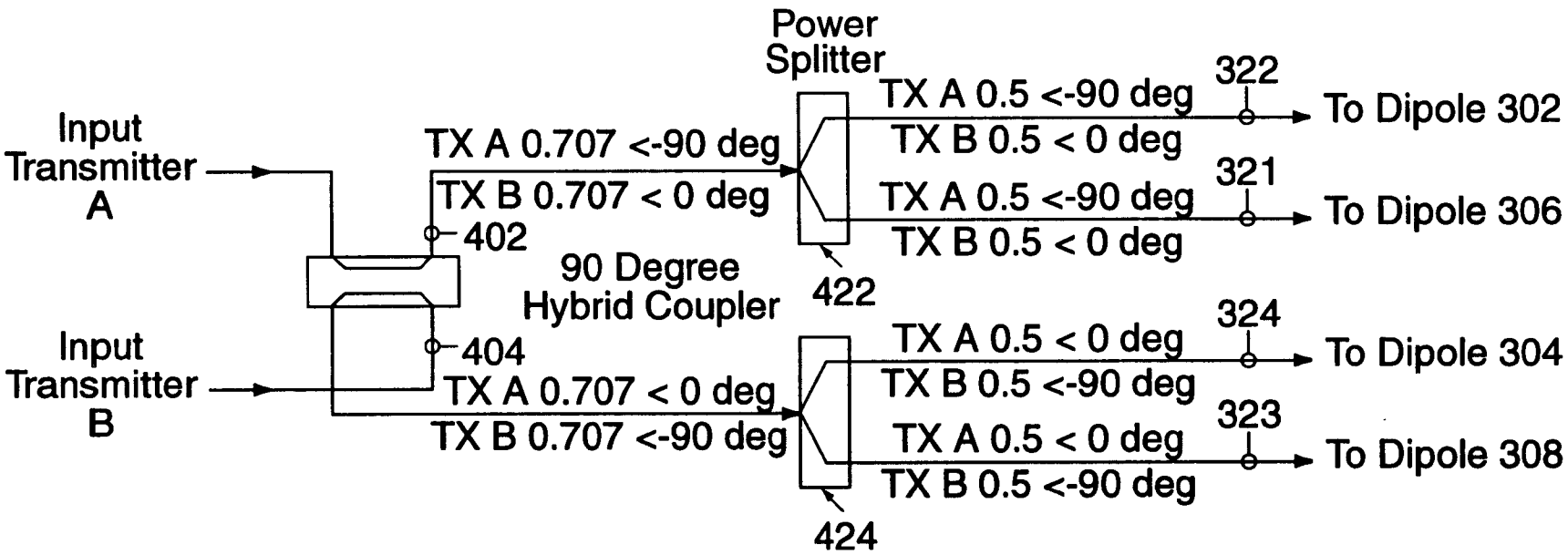
Figure 4. Block Diagram of TCI Orthogonal Mode Combiner

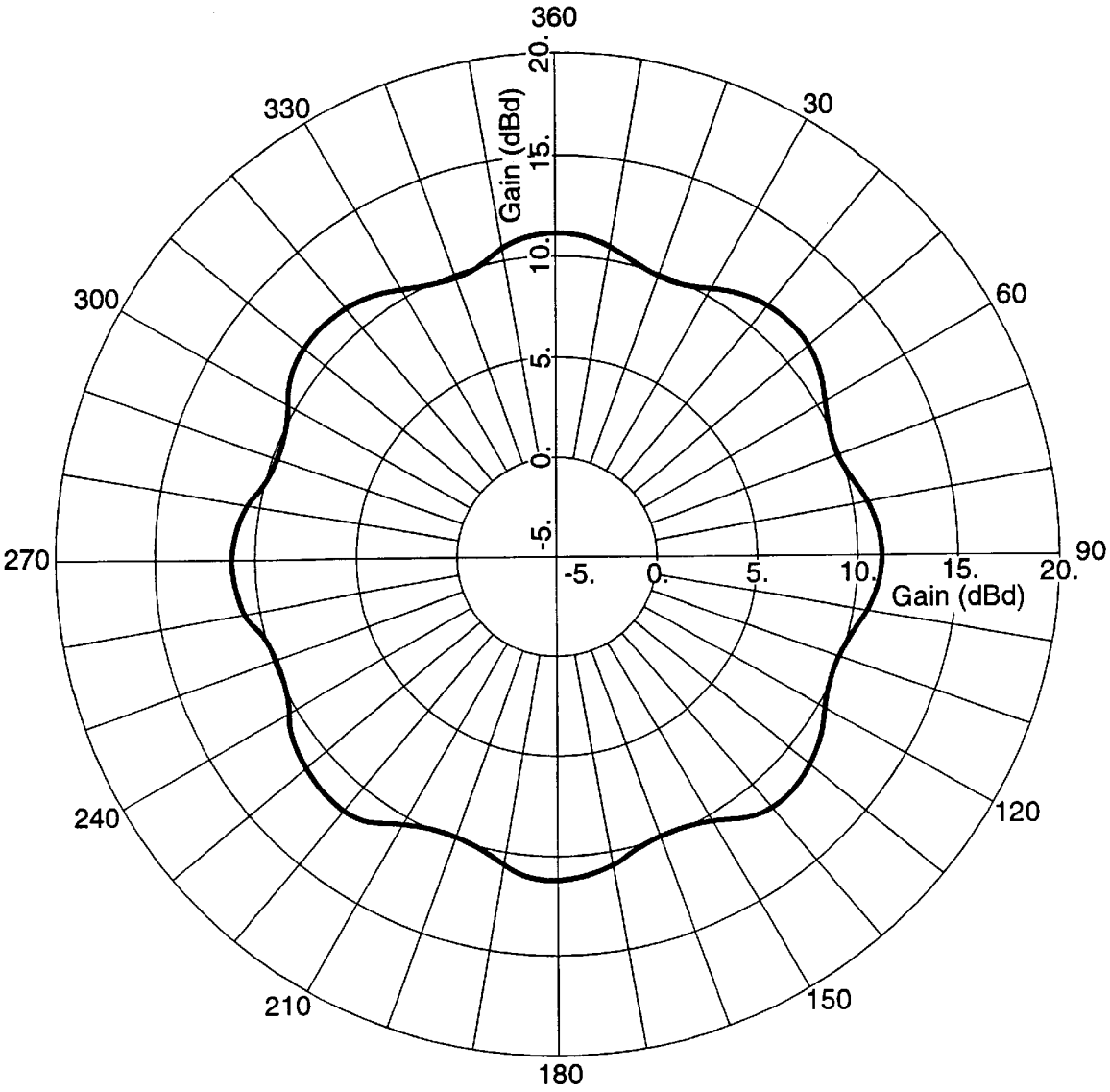
4 x 24 Horizontal Dipole Array. (1,1,1, .1)
Dipoles are 1' from Center.
No Beam Tilt. No Null Fill.
Omni Azimuth Pattern. Freq = 500.0 MHz
Figure 5A. Radiation Pattern

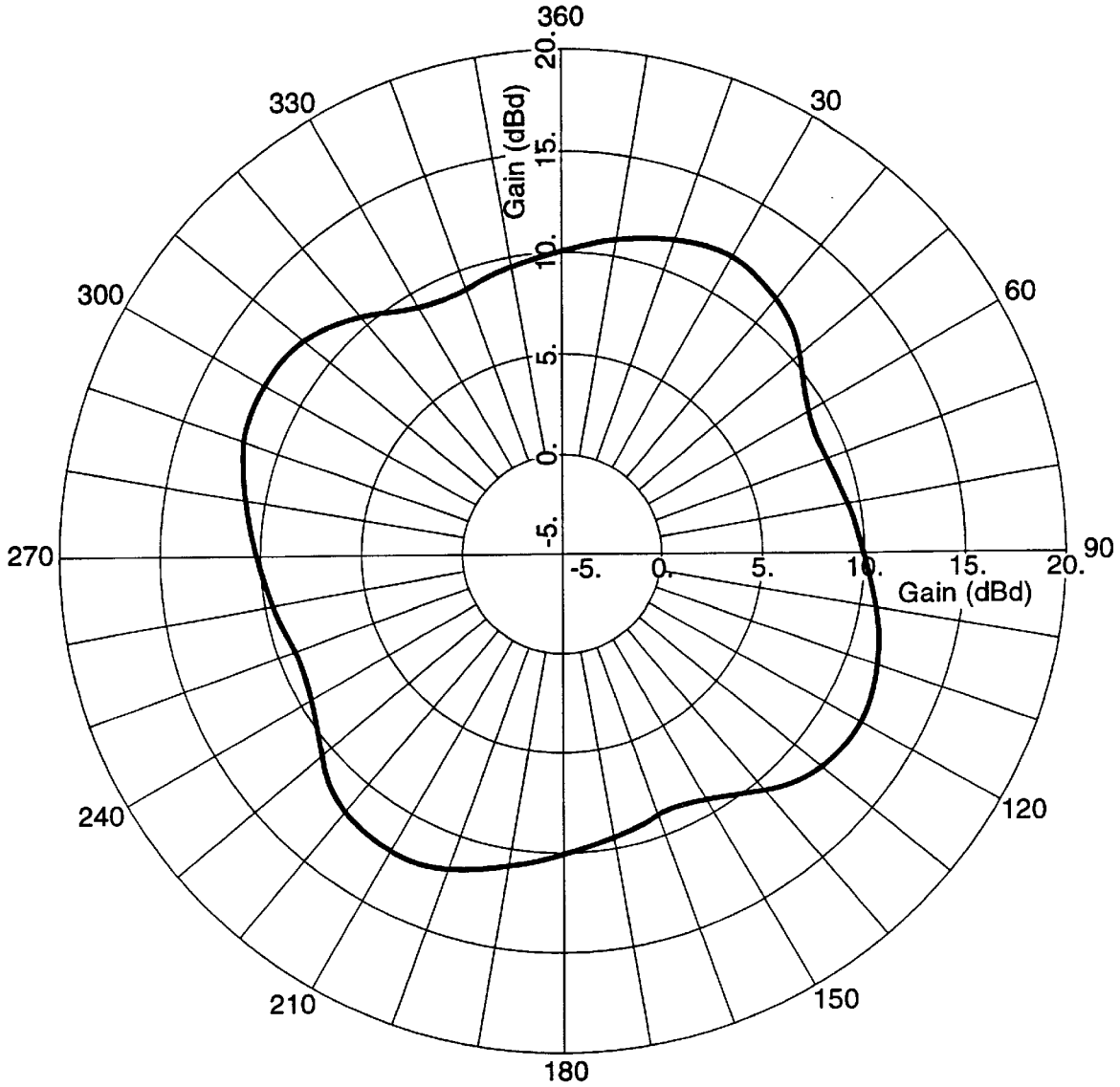
4 x 24 Horizontal Dipole Array. (1,j,-1,-j)
Dipoles are 1' from Center.
No Beam Tilt. No Null Fill.
Omni Azimuth Pattern. Freq = 500.0 MHz
Figure 5B. Radiation Pattern

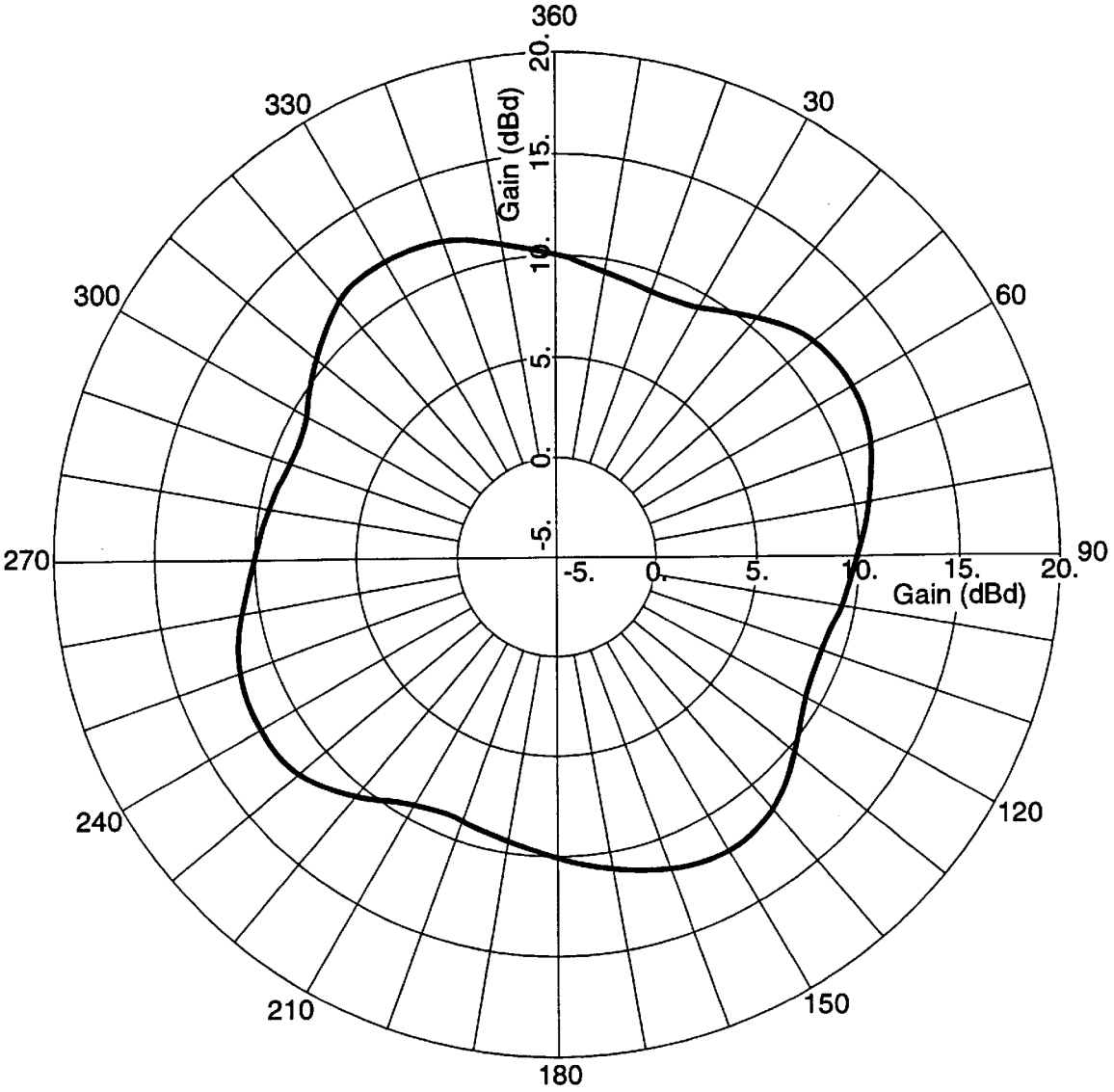
4 x 24 Horizontal Dipole Array. (1,-j,-1, j)
Dipoles are 1' from Center.
No Beam Tilt. No Null Fill.
Omni Azimuth Pattern. Freq = 500.0 MHz
Figure 5C. Radiation Pattern

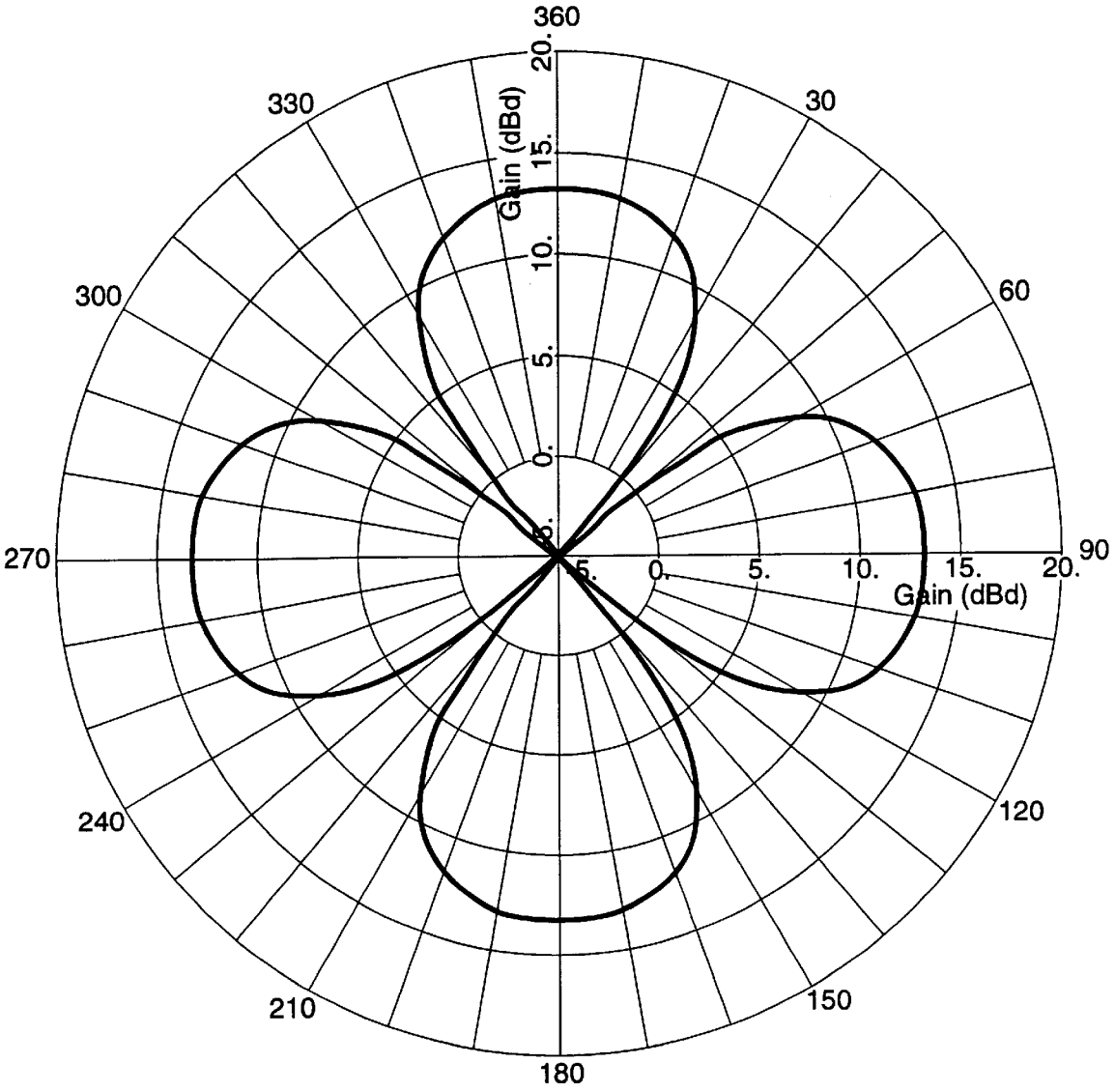
4 x 24 Horizontal Dipole Array. (1,-1,1, -1)
Dipoles are 1' from Center.
No Beam Tilt. No Null Fill.
Omni Azimuth Pattern. Freq = 500.0 MHz
Figure 5D. Radiation Pattern

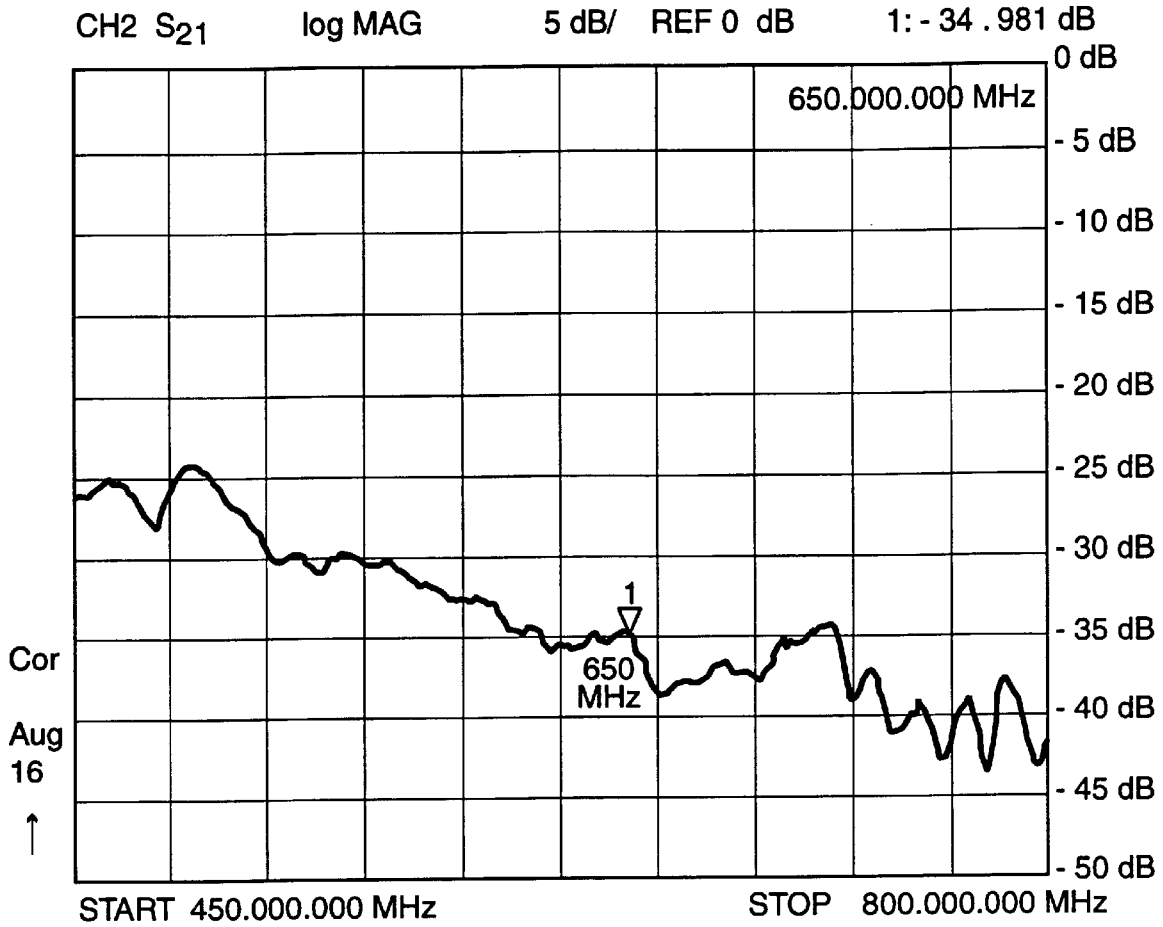
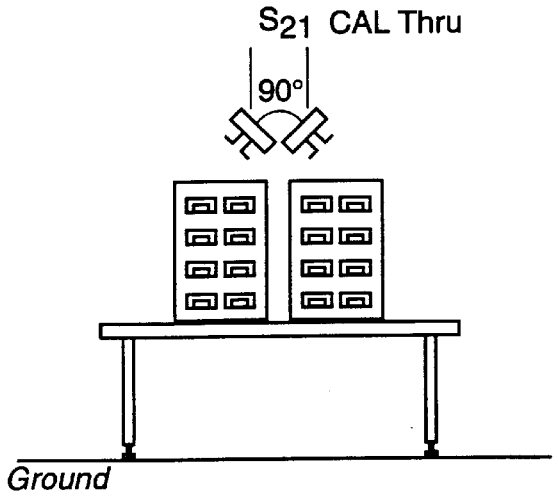
Figure 6. Isolation Between Orthogonal Panel Antennas

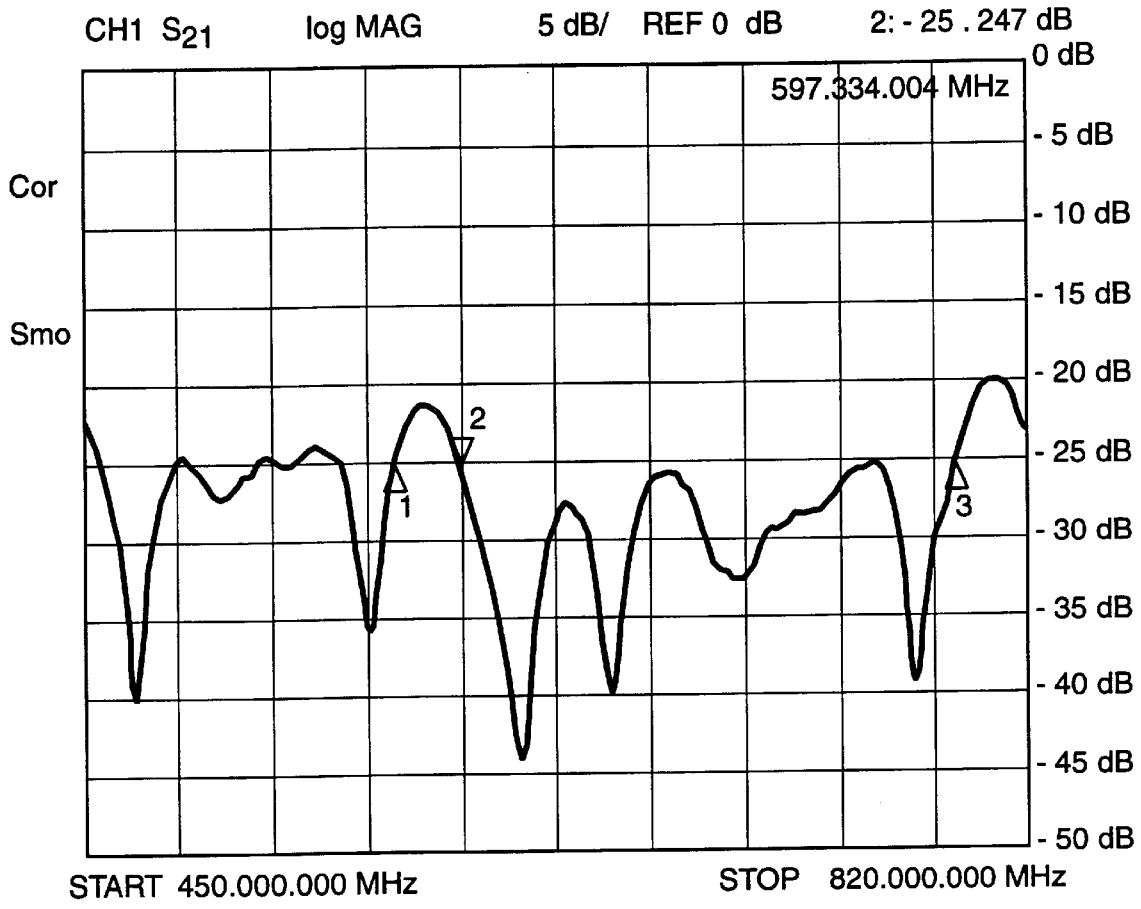
Figure 7. Dual Mode Panel Antenna System: Isolation Between Input Ports

METHOD AND APPARATUS FOR EXCITING A TELEVISION ANTENNA USING ORTHOGONAL MODES

BACKGROUND OF THE INVENTION

1. Field of the Invention

The present invention relates generally to methods and apparatuses for isolating two transmitters transmitting two different signals that are both driving a television antenna. More specifically, the invention relates to methods and apparatuses for transmitting two different signals from a television antenna using two orthogonal modes.

2. Description of the Related Art

Antennas for transmitting television signals typically transmit in the VHF (175 MHz to 250 MHz) frequency range or the UHF (470 MHz to 860 MHz) frequency range. In certain circumstances, it may be desirable to connect more than one transmitter to a transmitting antenna or antenna array. When this is done, it is important that energy from one transmitter that is coupled to the antenna not be coupled into another transmitter that is also coupled to the antenna. Coupling of energy from one transmitter to another transmitter would likely interfere with the operation of that transmitter and could in some cases destroy the transmitter.

In the past, it has been the practice in the United States to use individual antenna towers dedicated to a single television station and not to couple more than one signal to an antenna or antenna array. In Europe, the practice of coupling more than one signal to a single antenna or antenna array has been more common. The signals combined for transmission on a single array have generally been separated in frequency. This has enabled filters to be designed that are capable of isolating transmitters transmitting in one frequency band from other transmitters transmitting in other bands.

Recently, a need has arisen for simultaneously transmitting signals that are not separated in frequency using a single television antenna. With the advent of digital television, many television stations will, for some time at least, be required to simultaneously transmit both a digital as well as an analog version of their programming. The bandwidths that have been allocated for the separate transmissions, are, in some cases, adjacent to each other or at least very close in frequency. For example, in one scheme that is described below, adjacent 6 MHz channels are provided for simultaneous analog and digital transmission. Thus, if a television station wants to transmit both its digital signal and its analog signal using a single antenna or antenna array, then it is necessary to find a way to couple the two signals from a pair of transmitters to the single antenna or antenna array in a way that prevents the two transmitters from interfering with each other even when the two transmitters are transmitting at nearly the same frequency. A typical analog National Television Standards Committee (NTSC) television signal and a typical digital television signal are illustrated in FIG. 2. Conventional signal combining methods have not acceptably achieved the goal of separating such signals, as is detailed below.

FIG. 1A is a block diagram illustrating a star point combiner. A transmitter 100 and a transmitter 102 are both connected to a common output 103. Transmitter 100 is isolated from transmitter 102 using a highly tuned resonant circuit network 104. Transmitter 100 is connected to the left portion of highly tuned resonant circuit network 104 which is a bandpass filter for the signal from transmitter 100. Filter 104 rejects the energy from transmitter 102, but passes the energy from transmitter 100. Likewise, transmitter 102 is connected to a highly tuned resonant circuit network 105 which is a bandpass filter for the signal from transmitter 102. Filter 105 rejects the energy from transmitter 100, but passes the energy from transmitter 102.

The disadvantage of the star point combiner for the application described above is that it requires precise tuning of the bandpass filters. The absorption of energy by the filters requires an exact impedance match and the system does not work over a large bandwidth. Furthermore, the design also does not work well for two transmitters operating at nearly the same frequency.

FIG. 1B is a block diagram illustrating a commutating line combiner. The commutating line combiner includes a transformer 110 that includes two inputs for a first transmitter 111 and a second transmitter 112. The combined output of the two transmitters is obtained at output 116. The commutating line transformer depends on transmission line 118, which must have a length that corresponds to one half the wavelength at the difference in frequency between the two transmitter signals. If the frequency difference is small, then the length of transmission line 118 becomes unacceptably long. Furthermore, the frequency dependence of the combiner is undesirable and prevents it from working across a large bandwidth.

FIG. 1C is a block diagram illustrating a constant impedance combiner. The constant impedance combiner includes two inputs for a first transmitter 121 and a second transmitter 122. The signals from the two transmitters are combined at a combined output 124. In order to isolate second transmitter 122 from first transmitter 121, it is necessary to provide a pair of filters 126 and 128 which filter out the frequency band of the second transmitter. An advantage of this design is that additional combiners may be cascaded so that additional transmitters may be included. The problem with the design is the requirement of the filters. When the frequency bands of the two transmitters are close together, then it is difficult to obtain a notch filter with sharp enough roll off to filter out the frequency band of the second transmitter without affecting the signal from the first transmitter. Specifically, traditional filter devices have an attenuation slope that converts the FM modulated audio subcarrier of a NTSC analog signal into unwanted AM modulated signals. This adversely affects the video signal, which is AM modulated.

FIG. 2A is a block diagram illustrating in more detail the interference problem between a typical NTSC analog signal and a typical digital television signal when the DTV channel is assigned a 6 MHz bandwidth that is adjacent to and below the 6 MHz bandwidth assigned to an NTSC signal. The NTSC signal includes a video signal 200 and an audio signal 202 occupying the 6 MHz NTSC channel. The vestigial sideband of the video signal extends beyond the lower frequency boundary of the NTSC channel into the DTV channel. A digital television signal 210 is shown occupying the DTV channel adjacent to the NTSC analog signal. The separation between the upper frequency boundary of digital television signal 210 and the video signal is about 1.25 MHz. Because the vestigial sideband is not required by most modern systems, it is possible in certain instances to create a tuned filter that effectively blocks the portion of the video signal that extends into the DTV channel. It is essential, however, that the filter not cause amplitude modulation of the NTSC video signal. The case where the DTV channel is assigned to a bandwidth that is adjacent and above the NTSC bandwidth presents a more difficult problem because there is less frequency separation, as is shown in FIG. 2B.

FIG. 2B is a block diagram illustrating in more detail the interference problem between a typical NTSC analog signal and a typical digital television signal when the DTV channel is assigned a 6 MHz bandwidth that is adjacent to and above the 6 MHz bandwidth assigned to an NTSC signal. The NTSC signal includes a video signal 200 and an audio signal 202 occupying the 6 MHz NTSC channel. A digital television signal 210 is shown occupying the DTV channel adjacent to the NTSC analog signal. The audio signal is very close to the lower edge of the DTV channel. The separation between the lower frequency boundary of digital television signal 210 and the upper frequency boundary of audio signal 202 is as little as 250 kHz. It is exceedingly difficult to design a filter that can block the audio signal without affecting the DTV signal.

As a result of the bandwidth allocation illustrated in FIG. 2, any practical filter designed to block the digital television signal from reaching the NTSC transmitter will likely degrade the audio signal and any practical filter designed to block the NTSC signal from reaching the digital transmitter will likely degrade the digital television signal.

What is needed, therefore, is a system and method for combining signals from two television transmitters on a common antenna or antenna array that does not rely on filtering the signals. Additionally, it is preferable that the antenna array be designed so that the signals produced by the signal combiner generate a desirable omniazimuthal pattern when input to the array. Thus, a signal combiner, antenna feeding scheme and antenna array that together produce omniazimuthal patterns while isolating the inputs across a large bandwidth would be desirable.

SUMMARY OF THE INVENTION

Accordingly, the present invention provides a hybrid combiner that properly combines two radio frequency (RF) sources onto a four element antenna array at television frequencies in the UHF or VHF bands. The hybrid combiner provides isolated inputs to the system, allowing two RF sources to be combined without restrictions on the frequencies of the two sources, so long as the signals remain within the bandwidths of the antenna and the combiner, which typically cover the entire VHF or UHF bands. When the signals are input to the disclosed antenna array according to the scheme provided, a substantially omniazimuthal radiation pattern is obtained without significant nulls. The antenna array is configured so that the elements do not couple together so that the hybrid combiner and antenna array together provide a high degree of isolation between two RF sources.

It should be appreciated that the present invention can be implemented in numerous ways, including as a process, an apparatus, a system, a device, a method, or a computer readable medium. Several inventive embodiments of the present invention are described below.

In one embodiment, an antenna driving circuit for connecting an antenna to two transmitters is disclosed. The antenna driving circuit includes a hybrid combiner that has two isolated inputs. The hybrid is configured so that when a first signal is input to the first input, substantially one half of the energy of the first signal is output at the first output and the first signal is phase shifted by about −90 degrees at the first output. Substantially one half of the energy of the first signal is output at the second output and the first signal is phase shifted by about 0 degrees at the second output. When a second signal is input to the second input, substantially one half of the energy of the second signal is output at the second output and the second signal is phase shifted by about −90 degrees at the second output. Substantially one half of the energy of the second signal is output at the first output and the second signal is phase shifted by about 0 degrees at the first output. The input of a first power splitter is connected to the first output of the hybrid combiner and the output of the first power splitter is suitable for driving a first pair of dipole antenna arrays. The first pair of dipole antenna arrays are oriented in substantially opposite spatial directions. The input of a second power splitter is connected to the second output of the hybrid combiner and the output of the second power splitter is suitable for driving a second pair of dipole antenna arrays. The second pair of dipole antenna arrays are oriented in substantially opposite spatial directions that are oriented about 90 degrees away from both of the spatial directions of the first pair of dipole antenna arrays. The output of the first power splitter and the output of the second power splitter are suitable to drive the first and second pairs of dipole antenna arrays in two orthogonal modes.

In another embodiment, a system for transmitting two different isolated signals using a single antenna array includes a first pair of horizontally oriented dipole antennas. The first pair of horizontally oriented dipole antennas are pointed in substantially opposite directions. A second pair of horizontally oriented dipole antennas are pointed in substantially opposite directions that are substantially orthogonal to the first pair of horizontally oriented dipole antennas. A hybrid antenna array driving circuit includes a first input connected to a first signal, a second input connected to a second signal, a first output and a second output. The first input is isolated from the second input and the hybrid is configured so that when a first signal is input to the first input, substantially one half of the energy of the first signal is output at the first output and the first signal is phase shifted by about −90 degrees at the first output and substantially one half of the energy of the first signal is output at the second output and the first signal is phase shifted by about 0 degrees at the second output. When a second signal is input to the second input, substantially one half of the energy of the second signal is output at the second output and the second signal is phase shifted by about −90 degrees at the second output and substantially one half of the energy of the second signal is output at the first output and the second signal is phase shifted by about 0 degrees at the first output. A first power splitter input is connected to the first output of the hybrid antenna array driving circuit and the outputs of the first power splitter are connected to the first pair of horizontally oriented dipole antennas. a second power splitter input is connected to the second output of the hybrid antenna array driving circuit and the outputs of the second power splitter are connected to the second pair of horizontally oriented dipole antennas.

These and other features and advantages of the present invention will be presented in more detail in the following specification of the invention and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which:

FIG. 1A is a block diagram illustrating a star point combiner.

FIG. 1B is a block diagram illustrating a commutating line combiner.

FIG. 1C is a block diagram illustrating a constant impedance combiner.

FIG. 2 is a block diagram illustrating in more detail the interference problem between a typical NTSC analog signal and a typical digital television signal.

FIG. 3 is a schematic diagram illustrating a horizontal dipole antenna array that is connected to an orthogonal mode combiner in one embodiment of the present invention.

FIG. 4 is a schematic diagram of an orthogonal mode combiner that provides two isolated inputs for a pair of transmitters.

FIG. 5A is an antenna pattern generated for a 4 panel horizontal antenna array such as the one shown in FIG. 3 at a frequency of 500 MHz.

FIG. 5B is another antenna pattern generated for a 4 panel horizontal antenna array such as the one shown in FIG. 3 at a frequency of 500 MHz.

FIG. 5C is another antenna pattern generated for a 4 panel horizontal antenna array such as the one shown in FIG. 3 at a frequency of 500 MHz.

FIG. 5D is an antenna pattern generated by an orthogonal mode of excitation by the same system used to generate FIG. 5C except that the array is excited with the phase rotating in a left hand sense.

FIG. 6 is a graph illustrating the isolation achieved between two dipole arrays pointed 90 degrees away from each other and positioned one foot from the intersection of their center lines.

FIG. 7 is a graph illustrating the isolation between two transmitter inputs for a hybrid combiner circuit as shown in FIG. 4 driving a four element dipole array as shown in FIG. 3 in two separate orthogonal modes.

DETAILED DESCRIPTION OF THE PREFERRED EMBODIMENTS

Reference will now be made in detail to the preferred embodiment of the invention. An example of the preferred embodiment is illustrated in the accompanying drawings. While the invention will be described in conjunction with that preferred embodiment, it will be understood that it is not intended to limit the invention to one preferred embodiment. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

FIG. 3 is a schematic diagram illustrating a horizontal dipole antenna array 300 that is connected to an orthogonal mode combiner in one embodiment of the present invention. Dipole antenna array 300 includes horizontal dipole antennas 302, 304, 306, and 308 arranged counterclockwise beginning from the top, respectively. Dipole antennas 302, 304, 306, and 308 are enclosed by enclosures 312, 314, 316, and 318, respectively. It should be noted that in one embodiment, each dipole antenna is actually a vertical stacked array of horizontally oriented antennas that point in substantially the same direction, which is sometimes referred to as an antenna panel. It should be understood that, when a horizontal dipole antenna is referred to, the reference is intended to include such a stacked array as well. In one embodiment of the present invention each panel includes 24 stacked dipoles.

Consecutive antennas in the array are pointed in substantially orthogonal directions as is shown. In one embodiment, the antennas are pointed 90 degrees away from each other plus or minus 2 degrees. In one embodiment, the dipoles are arranged each about 1 foot away from the center of the array. Because dipole radiation patterns have a null along the axis of the dipole, radiation from one element does not tend to couple into adjacent elements. It is the avoidance of such coupling that drives how precisely the orthogonal configuration of the elements must be maintained. Also, it should be noted that the back sides of each of the dipole enclosures can be designed to prevent any radiation from leaking in the backwards direction. Thus, the antenna array elements are substantially isolated from each other as a result of their orientation.

Opposite panels are arranged so that their elements are out of phase with each other, that is, opposite elements are not oriented as if one of the dipole was rotated around the array into the position of the other. Instead, they are arranged as if one of the dipoles was both rotated and flipped into the position of the other. This allows a single 90 degree phase shifted signal to provide both a plus 90 and a minus 90 degree phase shift when input into the flipped antennas.

When two signals that are 90 degrees out of phase are generated from each transmitter by the orthogonal mode combiner shown in FIG. 4, it is possible to feed antenna array 300 in the manner described below that creates two orthogonal modes. One mode has a right hand sense to its excitation (i.e. 0, 90, 180, 270 degrees) and the other mode has a left hand sense to its excitation (i.e. 0, −90, −180, −270 degrees). These modes are shown by the signals that label each of the antenna arrays. The two transmitters thus excite the antenna array in two isolated, orthogonal modes. The only coupling of the modes in the antenna is created by imperfections in the antenna material and geometry so that a very high degree of isolation and wide bandwidth may be achieved.

FIG. 4 is a schematic diagram of an orthogonal mode combiner 400 that provides two isolated inputs for an input transmitter A and an input transmitter B. The two transmitter signals are fed into two isolated ports on a hybrid transformer 410. Hybrid transformer 410 provides equal power splitting between its output ports with a 90 degree phase offset between the outputs. The power splitting and phase relationship are maintained over approximately a 2:1 bandwidth. Thus the coupler is designed for operation at a mid-band frequency $f_0$ and will operate properly over a range of 0.66 $f_0$ to 1.33 $f_0$.

The signal input from transmitter A is transformed by hybrid transformer 410 to a −90 degrees phase shifted signal with half the input power at a node 402 and to a second half power signal that is not phase shifted at a node 404. Similarly, the signal input from transmitter B is transformed by hybrid transformer 410 to a −90 degree phase shifted signal with half the input power at node 404 and to a second half power signal that is not phase shifted at node 402. The combined signals at nodes 402 and 404 are each fed into power splitters 422 and 424, respectively. As a result, four signals on four lines 432, 434, 436, and 438 are obtained with each signal being a combination of the signals from the two transmitters with one of the transmitter signals being phase shifted by −90 degrees.

The combined signal at output 322 includes a one quarter power signal from transmitter A phase shifted by −90 degrees and a one quarter power signal from transmitter B that is not phase shifted. Output 322 is connected to dipole 302. The combined signal at output 324 includes a one quarter power signal from transmitter B phase shifted by −90 degrees and a one quarter power signal from transmitter A that is not phase shifted. Output 324 is connected to dipole 304. The combined signal at output 326 includes a one quarter power signal from transmitter A phase shifted by −90 degrees and a one quarter power signal from transmitter B that is not phase shifted. Output 326 is connected to dipole 306. As noted above, dipole 306 is flipped 180 degrees with respect to dipole 302. The combined signal at output 328 includes a one quarter power signal from transmitter B phase shifted by −90 degrees and a one quarter power signal from transmitter A that is not phase shifted. Output 328 is connected to dipole 308. As noted above, dipole 308 is flipped 180 degrees with respect to dipole 304.

When all of the connections are made as described above, the antenna array is driven by the two transmitters in two isolated, orthogonal modes. As shown, transmitter A has a left hand sense to its excitation of the array and transmitter B has a right hand sense to its excitation. The combiner and antenna array are designed to operate across a wide bandwidth. In one embodiment, the antenna and combiner cover the entire VHF television band. In another embodiment, the antenna and combiner cover the entire UHF television band. Typical isolation figures that have been achieved between the transmitters are in the range of 30 dB to 35 dB. The omniazimuthal antenna patterns obtained from the orthogonal modes are described in FIGS. 5C and 5D. The isolation between adjacent antenna panels is further described in FIGS. 6 and the isolation achieved for a complete dual mode UHF television antenna system is shown in FIG. 7.

FIG. 5A is an antenna pattern generated for a 4 panel horizontal antenna array such as the one shown in FIG. 3 at a frequency of 500 MHz. Each of the panels includes 24 dipoles that point in the same direction and are vertically stacked. The dipoles are positioned 1 foot from the center of the array. Each of the dipoles are fed in phase with the others. The omniazimuthal pattern that is obtained without nulls is nearly ideal. However, since each of antenna panels are fed in phase, the phase shifted signals output by the circuit of FIG. 4 would not be used in this arrangement.

FIG. 5B is another antenna pattern generated for a 4 panel horizontal antenna array such as the one shown in FIG. 3 at a frequency of 500 MHz. Again, each of the panels includes 24 dipoles that point in the same direction and are vertically stacked and the dipoles are positioned 1 foot from the center of the array. Each of the dipoles are fed in phase with the others. In this case, alternate panels are fed with signals that are 180 degrees out of phase. The resulting pattern is not omniazimuthal and is therefore not desirable. Thus, although combiners could be designed that could output isolated signals 180 degrees out of phase, the patterns resulting from feeding the array using such signals would not be preferred.

FIG. 5C is another antenna pattern generated for a 4 panel horizontal antenna array such as the one shown in FIG. 3 at a frequency of 500 MHz. Again, each of the panels includes 24 dipoles that point in the same direction and are vertically stacked and the dipoles are positioned 1 foot from the center of the array. Each of the dipoles are fed in phase with the others. In this case, alternate panels are fed with signals obtained from a 90 degree hybrid combiner that are 90 degrees out of phase. The signals are input so that the phase rotates around the array in a right hand sense. FIG. 5C illustrates the benefit of feeding the antenna array using the antenna feeder circuit shown in FIG. 4. The resulting pattern is omniazimuthal with no nulls. FIG. 5D is an antenna pattern generated by an orthogonal mode of excitation by the same system used to generate FIG. 5C except that the array is excited with the phase rotating in a left hand sense. Again, the pattern is omniazimuthal with no nulls. Thus, it has been shown that a good omniazimuthal antenna pattern may be output using the combiner circuit disclosed in FIG. 4.

FIG. 6 is a graph illustrating the isolation achieved between two dipole arrays pointed 90 degrees away from each other and positioned one foot from the intersection of their center lines. The amount of isolation is plotted on the y axis and the frequency is plotted on the x axis. As can be seen, isolation is greater than 30 dB in the UHF bands. Since, as described above, leakage in the backward direction can be practically eliminated by the shielded back of the antenna enclosure as is well known, two more orthogonal dipole arrays could be added to create an array as shown in FIG. 3 without significantly increased coupling between panels. Thus, it has been shown that the 4 panel antenna array has sufficient isolation between the panels to be suitable for broadcasting a pair of isolated transmission signals.

FIG. 7 is a graph illustrating the isolation between two transmitter inputs for a hybrid combiner circuit as shown in FIG. 4 driving a four element dipole array as shown in FIG. 3 in two separate orthogonal modes. The isolation across a broad range of frequencies is generally better than 25 dB. In some frequency ranges, isolation is better than 30 dB or 35 dB. By selecting correct overall phase length between antenna elements, the maxima and minima of isolation can be adjusted to select optimum isolation for a given pair of adjacent channels. Isolations of up to 40 dB can therefore be achieved. In one embodiment, isolation is further enhanced by placing a conventional bandpass filter on each of the inputs. One advantage of the design is that using such a filter does not degrade the other input signal quality.

By selecting correct overall phase length between antenna elements, the maxima and minima of isolation can be adjusted to select optimum isolation for a given pair of adjacent channels. Isolations of up to 40 dB can therefore be achieved.

FIG. 7 shows that isolation has been achieved for two transmitters over a very wide bandwidth for the tested four element dipole array. Each element included a stack of 4 dipoles. FIGS. 5C and 5D show that the antenna patterns obtained are omniazimuthal within a few dB. The disclosed combiner may be applied to any pair of transmitters operation within the bandwidth of the antenna and coupler. No tuned circuits are required, providing design flexibility. The disclosed combiner also allows isolation of signals at frequency combinations that are not practical to isolate using conventional filtering.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. For example, array elements other than dipole antennas may be used in certain embodiments. Also, different combiners that provide phase shifted outputs that can be used to broadcast other substantially omniazimuthal signals may be used. Accordingly, the present embodiments are to be considered as illustrative and not restrictive, and the invention is not to be limited to the details given herein, but may be modified within the scope and equivalents of the appended claims.

What is claimed is:

1. An antenna driving circuit for connecting an antenna to two transmitters comprising:

a hybrid combiner having a first input, a second input, a first output and a second output, the first input being isolated from the second input wherein the hybrid is configured so that when a first signal is input to the first input, substantially one half of the energy of the first signal is output at the first output and the first signal is phase shifted by about −90 degrees at the first output and substantially one half of the energy of the first signal is output at the second output and the first signal is phase shifted by about 0 degrees at the second output; and when a second signal is input to the second input, substantially one half of the energy of the second signal is output at the second output and the second signal is phase shifted by about −90 degrees at the second output and substantially one half of the energy of the second signal is output at the first output and the second signal is phase shifted by about 0 degrees at the first output;

a first power splitter wherein the input of the first power splitter is connected to the first output of the hybrid combiner and the output of the first power splitter is suitable for driving a first pair of dipole antenna arrays, the first pair of dipole antenna arrays being oriented in substantially opposite spatial directions; and a second power splitter wherein the input of the second power splitter is connected to the second output of the hybrid combiner and the output of the second power splitter is suitable for driving a second pair of dipole antenna arrays, the second pair of dipole antenna arrays being oriented in substantially opposite spatial directions that are oriented about 90 degrees away from both of the spatial directions of the first pair of dipole antenna arrays;

whereby the output of the first power splitter and the output of the second power splitter are suitable to drive the first and second pairs of dipole antenna arrays in two orthogonal modes.

2. An antenna driving circuit for connecting an antenna to two transmitters as recited in claim 1 wherein the antenna driving circuit is suitable for use in the VHF and UHF bands.

3. An antenna driving circuit for connecting an antenna to two transmitters as recited in claim 1 wherein the antenna driving circuit is suitable for driving a four element horizontal dipole array antenna.

4. A system for transmitting two different isolated signals using a single antenna array comprising:

a first pair of horizontally oriented dipole antennas wherein the first pair of horizontally oriented dipole antennas are pointed in substantially opposite directions;

a second pair of horizontally oriented dipole antennas wherein the second pair of horizontally oriented dipole antennas are pointed in substantially opposite directions, the second pair of horizontally oriented dipole antennas being oriented substantially orthogonally to the first pair of horizontally oriented dipole antennas;

a hybrid antenna array driving circuit having a first input connected to a first signal, a second input connected to a second signal, a first output and a second output, the first input being isolated from the second input wherein the hybrid is configured so that when a first signal is input to the first input, substantially one half of the energy of the first signal is output at the first output and the first signal is phase shifted by about −90 degrees at the first output and substantially one half of the energy of the first signal is output at the second output and the first signal is phase shifted by about 0 degrees at the second output; and when a second signal is input to the second input, substantially one half of the energy of the second signal is output at the second output and the second signal is phase shifted by about −90 degrees at the second output and substantially one half of the energy of the second signal is output at the first output and the second signal is phase shifted by about 0 degrees at the first output;

a first power splitter wherein the input of the first power splitter is connected to the first output of the hybrid antenna array driving circuit and the outputs of the first power splitter are connected to the first pair of horizontally oriented dipole antennas; and a second power splitter wherein the input of the second power splitter is connected to the second output of the hybrid antenna array driving circuit and the outputs of the second power splitter are connected to the second pair of horizontally oriented dipole antennas.

5. A system for transmitting two different isolated signals using a single antenna array as recited in claim 4 wherein the first pair of horizontally oriented dipole antennas comprises a vertically stacked array of dipole antennas and wherein the second pair of horizontally oriented dipole antennas comprises a vertically stacked array of dipole antennas.

* * * * *